US006474239B2

(12) United States Patent
Leblond et al.

(10) Patent No.: US 6,474,239 B2
(45) Date of Patent: Nov. 5, 2002

(54) IGNITER TUBE FOR ARTILLERY AMMUNITION

(75) Inventors: Joël Leblond, Bourges (FR); Bernard Pieuchot, Salbris (FR); Raymond Capdevielle, Odos (FR)

(73) Assignee: Giat Industries (FR)

( * ) Notice: Subject to any disclaimer, the term of this patent is extended or adjusted under 35 U.S.C. 154(b) by 35 days.

(21) Appl. No.: 09/731,794

(22) Filed: Dec. 8, 2000

(65) Prior Publication Data

US 2001/0018878 A1 Sep. 6, 2001

(30) Foreign Application Priority Data

Dec. 8, 1999 (FR) ..... 99 15710

(51) Int. Cl.[7] ..... C06C 7/00
(52) U.S. Cl. ..... 102/202
(58) Field of Search ..... 102/202, 204, 102/469, 470

(56) References Cited

U.S. PATENT DOCUMENTS

| | | | | | |
|---|---|---|---|---|---|
| 38,994 | A | * | 6/1863 | Tice | 102/204 |
| 223,312 | A | * | 1/1880 | Brand | 102/204 |
| 3,182,595 | A | * | 5/1965 | Hassmann | 102/202 |
| 3,667,391 | A | * | 6/1972 | Amiable et al. | 102/202 |
| 3,750,581 | A | * | 8/1973 | Betts et al. | 102/202 |
| 3,899,973 | A | * | 8/1975 | Brocart | 102/202 |
| 4,353,304 | A | * | 10/1982 | Hubsch et al. | 102/202.14 |
| 4,358,998 | A | * | 11/1982 | Schneiter et al. | 102/202 |
| 4,669,383 | A | * | 6/1987 | Penner | 102/202 |
| 4,674,405 | A | * | 6/1987 | Brede et al. | 102/202 |
| 4,770,099 | A | * | 9/1988 | Brede et al. | 102/202.14 |
| 5,069,130 | A | * | 12/1991 | Buckley et al. | 102/202 |
| 5,227,577 | A | * | 7/1993 | Eich et al. | 102/202 |
| 5,335,600 | A | * | 8/1994 | Horr et al. | 102/202 |
| 5,345,871 | A | * | 9/1994 | Stang | 102/202 |
| 5,767,439 | A | * | 6/1998 | Lindblom et al. | 102/202 |
| 5,895,881 | A | * | 4/1999 | Thiesen et al. | 102/202 |
| 6,257,148 | B1 | * | 7/2001 | Toivonen et al. | 102/293 |
| 6,272,996 | B1 | * | 8/2001 | O'Brien et al. | 102/275.1 |
| 6,321,630 | B1 | * | 11/2001 | Woodall et al. | 102/403 |

FOREIGN PATENT DOCUMENTS

| | | |
|---|---|---|
| EP | 0 822 385 A1 | 2/1998 |
| FR | 2 591 735 | 6/1987 |
| FR | 2 593 905 | 8/1987 |
| GB | 683247 | 11/1952 |
| GB | 1 535 733 | 12/1978 |

* cited by examiner

*Primary Examiner*—Charles T. Jordan
*Assistant Examiner*—Jordan M Lofdahl
(74) *Attorney, Agent, or Firm*—Parkhurst & Wendel, L.L.P.

(57) ABSTRACT

The invention relates to an igniter tube, notably for artillery ammunition, and comprising a stack of at least two ring-shaped tablets made of an igniting composition and joined together by a heat-shrinkable sheath.

This tube incorporates a case having a tubular part inside which the stack of tablets is introduced leaving a little play, the tubular part thus covering at least part of the stack, and it comprises a ring made integral with the tablets by the heat-shrinkable sheath, said ring incorporating an abutment surface that is held by retention means against a matching surface carried by a bore of the case.

Application to the ignition of ammunition propellant charges.

8 Claims, 1 Drawing Sheet

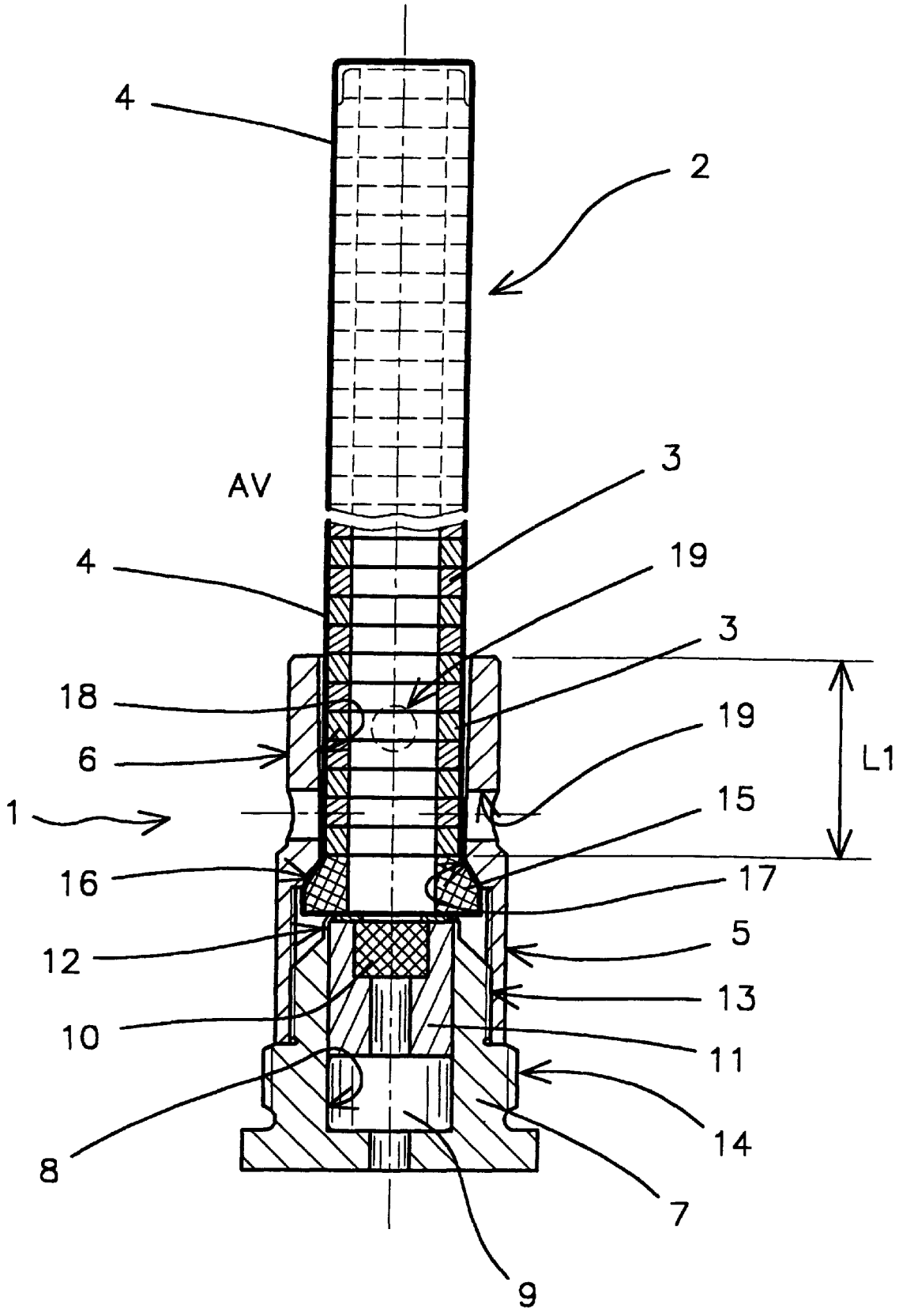
4
2
AV
3
4
19
3
18
19
6
L1
1
15
16
17
12
5
13
10
11
8
14
7
9

IGNITER TUBE FOR ARTILLERY AMMUNITION

BACKGROUND OF THE INVENTION

The technical scope of the invention is that of igniter tubes, notably for artillery.

DESCRIPTION OF RELATED ART

Known igniter tubes generally incorporate a stack of tablets of igniting composition, for example black powder, placed inside a tube, generally metallic.

Today, ammunition used in combat vehicles more and more frequently comprises a case made of a combustible material.

Thus, after the ammunition has been fired, the only part to be ejected from the chamber and then temporarily stored in the turret is the metallic base.

Metallic igniter tubes have the disadvantage of protruding from the base thereby complicating its ejection and storage.

Patent FR-A-2593905 proposes the replacement of the metallic tube by a heat-shrinkable sheath that keeps the tablets together as well as a case carrying igniting means (for example a squib), such case being attached to the base by screwing.

The advantage of such a solution lies in that it ensures the quasi-total combustion of the igniter tube. The only incombustible part is formed by the support case that is of a height that is less than that of the base and thus does not hinder its ejection.

Moreover, the tube has a certain flexibility that facilitates its installation in the load.

However, this tube still has certain drawbacks.

The heat-shrinkable sheath has thus been found to be subject to embrittlement along the joins between the tablets and the support case. Such embrittlement can lead to fracture further to the mechanical vibrations and stresses to which the ammunition is subjected during the transport and storage phases.

Such an embrittlement is due partly to the grains of powder striking the joins between the stack of tablets and the support case, and partly to the stresses that are developed within this join during bending movements of the igniter tube.

SUMMARY OF THE INVENTION

The aim of the invention is to propose an igniter tube that overcomes such drawbacks.

Thus, the igniter tube according to the invention retains the flexibility conferred by the heat-shrinkable sheath but provides improved stress-resistance.

The tube according to the invention is simple in design and can be produced at a reduced cost.

Thus, the invention relates to an igniter tube, notably for artillery ammunition, and comprising a stack of at least two ring-shaped tablets made of an igniting composition and joined together by a heat-shrinkable sheath and ignition means for these tablets that is integral with a case, wherein the case incorporates a tubular part inside which the stack of tablets is introduced leaving a little play, the tubular part thus covering at least part of the stack, and wherein it comprises a ring made integral with the tablets by the heat-shrinkable sheath, said ring incorporating an abutment surface that is held by retention means against a matching surface carried by a bore of the case.

According to a preferred embodiment of the invention, the bore arranged in the tubular part is conical in shape, the tip of the cone being on the ring side.

The ring will preferably be made of a compressible material.

The compressible material can be selected from among the following materials: polyurethane elastomer, rubber, nitryl, polyurethane foam.

The abutment surface of the ring can be a conical surface.

The retention means can be formed by a plug integral with the case and supporting the ignition means.

The tubular part will preferably be of a length able to cover five tablets.

The tubular part is provided with at least two radial holes evenly spaced angularly.

BRIEF DESCRIPTION OF THE DRAWING

The invention will be better understood after reading the following description of an embodiment, such description being made with reference to the appended drawing, which FIG. 1 shows a partial longitudinal section of an igniter tube according to an embodiment of the invention.

DETAILED DESCRIPTION OF THE PREFERRED EMBODIMENTS

According to this FIG. 1, an igniter tube 1 according to the invention comprises a stack 2 of ring-shaped tablets 3 of igniting composition, for example black powder, that are joined together by a heat-shrinkable sheath 4.

Such a stack is described in detail in patent FR-A-2593905 the whole of the description of which is included here by way of reference and to which reference may be made.

A stack of 50 tablets each of 1 gram in mass and 5 mm in thickness can be made, for example.

The stack 2 is made integral with a case 5 that comprises a tubular part 6 closed at its rear part by a plug 7.

The plug 7 constitutes a conventional ignition unit that has an axial cylindrical housing 8 for ignition means formed, for example, by an electric or percussion squib 9 connected to a pyrotechnic flame-intensifying relay 10. Squib 9 and relay 10 are separated by a spacer 11. They are made integral with the plug 7 by annular crimping 12.

The plug 7 incorporates a first external threading 13 that allows it to be attached to the case 5 and a second external threading 14 that allows the igniter tube 1 to be attached to the base of the ammunition (not shown).

In accordance with the invention, a ring 15 is made integral with the stack 2 of tablets by means of the heat-shrinkable sheath 4. This ring incorporates an abutment surface 16, that here is conical in shape, and that is held against a matching surface 17 on a bore 18 of the case 5 by retention means. The co-operation of the conical surfaces ensures that the stack 2 is centered with respect to the case 5.

The retention means are here formed by the plug 7 whose length is such that, after being screwed onto the case 5, its crimping 12 presses against the ring 15.

The bore 18 is slightly conical (angle at the tip of 5° to 10°). The tip of the cone of the plug 7 and the maximal diameter of the bore being at the side of a front part AV of the case 5.

The tapering of the bore 18 allows slight bottoming of the stack 2 of tablets, without mechanical interference with the case. The tubular part 6 thus covers at least one part of the length L1 of the stack 2 of tablets 3.

The length L1 will be chosen to that the tubular part 6 covers at least 5 tablets 3 of igniting composition. A length L1 will be chosen such that, after the ammunition has been ignited, the tubular part 6 of the case 5 does not protrude from the ammunition base to be ejected. In practical terms, length L1 is around 30 to 40 mm.

Thus, thanks to the invention, there is no longer a join between the support case and the stack of tablets that would be in contact with the powder load (not shown) in an ammunition case. The resistance of the stack to the stresses caused by the ammunition is thus greatly improved and the risks of the igniter tube being fractured are reduced.

According to another characteristic of the invention, the ring 15 will advantageously be made of a compressible material, for example a polyurethane elastomer with a Shore A hardness of around 70 to 80 (according to standard ASTM D785).

The ring can also be made of nitryl rubber or polyurethane foam. Choosing such a material gives a certain flexibility to the join between the stack 2 of tablets and the case 5. The igniter tube 1 can thus tolerate slight angular deformation with respect to the case without the danger of fracture.

The tubular part 6 of the case 5 will advantageously have radial holes 19 evenly spaced angularly (here 4 holes). The holes allow the passage of the flame generated by the tablets 3 inside the tubular part 6.

Thus, the tubular part 6 causes practically no disturbance to the ignition of the propellant charge.

Additionally, it ensures the rigid retention of a length L1 of the stack 2 of tablets 3. Such an arrangement ensures, in the event of the accidental fracture of the stack 2 at the part outside of the tubular part 6, the continued presence of an igniter tube of a minimal length L1 and able to ensure ignition. The igniter tube's operating reliability and safety are thus improved.

Different variants are possible without departing from the scope of the invention. It is thus possible to vary the shape of the ring 15 and notably its abutment surface that can be plane or hemispherical.

It is also possible to make the tablets of a pyrotechnic igniting composition other than black powder. For example, tablets can be made of a mixture of boron/potassium nitrate incorporating a nitrocellulose-based binder.

What is claimed is:

1. An igniter tube for artillery ammunition, comprising:

a stack of at least two ring-shaped tablets made of an igniting composition;

a ring comprising an abutment portion (16) having a diameter larger than a diameter of said tablets, said abutment portion having an abutment surface, wherein said stack and said ring are connected by a heat-shrinkable sheath;

a retention means; and a case including ignition means for said tablets, said case comprising:

a tubular part for enclosing at least part of said stack of tablets and ring which loosely fit within said tubular part, wherein said retention means is for holding said abutment surface against a matching surface of a bore of said case, so that said matching surfaces center the stack in the tubular portion.

2. An igniter tube according to claim 1, wherein said bore is conical and has the smallest diameter adjacent the ring.

3. An igniter tube according to claim 2, wherein said ring comprises a compressible material.

4. An igniter tube according to claim 3, wherein said compressible material is selected from the group consisting of polyurethane elastomer, rubber, nitryl and polyurethane foam.

5. An igniter tube according to claim 1, wherein said abutment surface is a conical surface.

6. An igniter tube according to claim 1, wherein said retention means comprises a plug integral with said case and supporting said ignition means.

7. An igniter tube according to claim 1, wherein said tubular part encloses five tablets of said stack.

8. An igniter tube according to claim 7, wherein said tubular part has at least two radial holes angularly evenly spaced.

* * * * *